US007882846B2

(12) United States Patent
Harbaugh

(10) Patent No.: US 7,882,846 B2
(45) Date of Patent: Feb. 8, 2011

(54) UMBRELLA WITH DOME SHAPE

(76) Inventor: Kenneth A. Harbaugh, 9886 Riverwood Ct., Douglasville, GA (US) 30135

( * ) Notice: Subject to any disclaimer, the term of this patent is extended or adjusted under 35 U.S.C. 154(b) by 0 days.

(21) Appl. No.: 12/488,964

(22) Filed: Jun. 22, 2009

(65) Prior Publication Data

US 2009/0255563 A1 Oct. 15, 2009

Related U.S. Application Data

(63) Continuation of application No. 11/231,338, filed on Sep. 20, 2005, now abandoned.

(51) Int. Cl.
*A45B 25/18* (2006.01)
*A45B 15/00* (2006.01)

(52) U.S. Cl. ..... 135/33.2; 135/33.5; 135/33.41

(58) Field of Classification Search ..... 135/33.2, 135/33.4, 33.41, 33.5, 905, 98, 27, 23
See application file for complete search history.

(56) References Cited

U.S. PATENT DOCUMENTS 978,213 A * 12/1910 Rose ..... 135/31
2,319,118 A * 5/1943 Farkas et al. ..... 135/31
5,284,172 A * 2/1994 Teate, Jr. ..... 135/27

* cited by examiner

*Primary Examiner*—David Dunn
*Assistant Examiner*—Danielle Jackson
(74) *Attorney, Agent, or Firm*—Kilpatrick Stockton LLP

(57) ABSTRACT

An umbrella comprises a vertical support member and a plurality of ribs operatively associated with the vertical support member and extending generally radially outward from a central location. The umbrella further includes a plurality of elongated, laterally flexible members, one of the flexible members being operatively associated with each of the plurality of ribs and extending outward therefrom. A canopy is supported by the plurality of ribs and has a periphery extending beyond the ribs. Receptacles are disposed on the inner surface of the canopy at points proximate the periphery of the canopy and in substantial alignment with a corresponding rib. The outer end of each flexible member engages a corresponding one of the receptacles. The canopy and the flexible members are configured such that the canopy exerts a tension on the flexible member that causes it to flex inward and downward.

12 Claims, 3 Drawing Sheets

UMBRELLA WITH DOME SHAPE

CROSS-REFERENCE TO RELATED APPLICATIONS

This application is a continuation of U.S. Ser. No. 11/231,338 filed Sep. 20, 2005.

TECHNICAL FIELD

The present invention relates generally to patio umbrellas and relates more specifically to a patio umbrella with a dome shape.

BACKGROUND OF THE INVENTION

Patio umbrellas are well known. The conventional patio umbrella is supported by a vertical member either in the center of the umbrella or laterally offset from the umbrella. Typically the umbrella consists of a plurality of radially extending ribs with a canopy stretched over the ribs. The perimeter of the canopy drapes downward loosely over the ends of the ribs.

SUMMARY OF THE INVENTION

Stated generally, the present invention comprises a patio umbrella in which the perimeter of the canopy extends outward and downward in an arcuate shape, creating a canopy with a domed appearance. The patio umbrella of the present invention is preferably supported by a vertical member either in the center of the umbrella or laterally offset from the umbrella.

Stated somewhat more specifically, the present invention relates to an umbrella comprising a vertical support member and a plurality of ribs operatively associated with the vertical support member and extending generally radially outward from a central location. The umbrella further includes a plurality of elongated, laterally flexible members, one of the flexible members being operatively associated with each of the plurality of ribs and extending outward therefrom. A canopy is supported by the plurality of ribs and has a periphery extending beyond the ribs. Receptacles are disposed on the inner surface of the canopy at points proximate the periphery of the canopy and in substantial alignment with a corresponding rib. The outer end of each flexible member engages a corresponding one of the receptacles. The canopy and the flexible members are configured such that the canopy exerts a tension on the flexible member that causes it to flex inward and downward.

Thus it is an object of the present invention to provide an umbrella of enhanced aesthetic appeal.

It is another object of the present invention to provide an umbrella whose canopy is shaped somewhat like a dome.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 1:
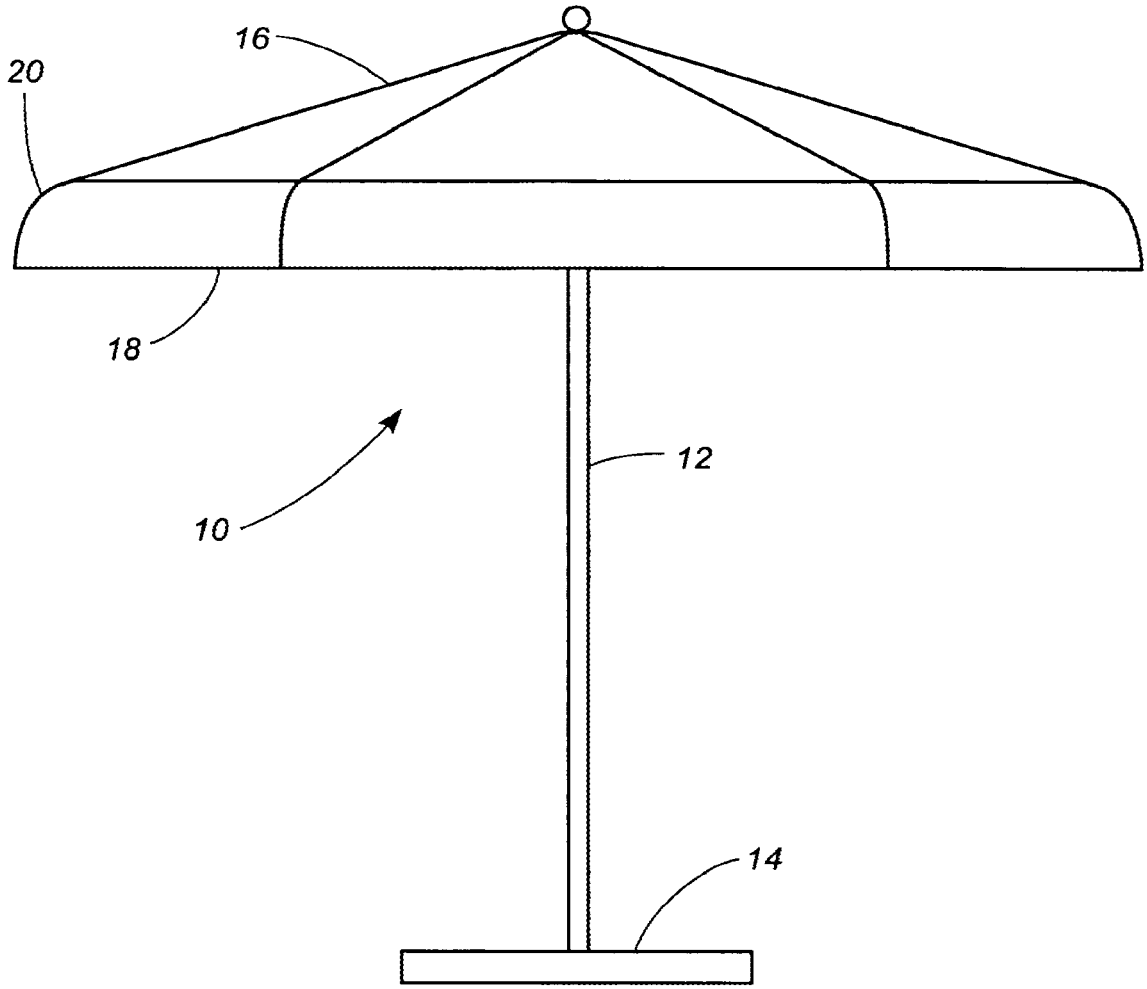
FIG. 1 is a side view of an umbrella having a dome shape.

Referring now to the drawings, in which like numerals indicate like elements throughout the several views, FIG. 1 illustrates a patio umbrella 10 according to a disclosed embodiment of the present invention. The umbrella 10 is supported by a vertical mast 12 that rests on a base 14. A skeletal structure of ribs (not shown in FIG. 1, but well known to those skilled in the art) radiates outward from the upper end of the vertical mast 12 and supports a canopy 16. The canopy has a periphery 18.

Patio umbrellas are also known in which the vertical mast is offset laterally from the rib structure and canopy. An example of an offset umbrella is shown in my U.S. Pat. No. 5,937,882, which is incorporated herein by reference. In an offset umbrella, a cantilever support arm extends from the offset mast to the central portion of the canopy. The umbrella structure herein disclosed is equally applicable to such offset umbrellas. As used herein, when it is stated that ribs are "operatively associated" with a vertical support member, it will be understood to include both central mast umbrellas, in which the ribs are directly mounted to the central mast, and offset umbrellas, where the ribs are operatively associated with the offset mast by way of the cantilever arm.

Of further note in FIG. 1 is the smoothly rounded contour of the shoulders 20 of the canopy 16. The smoothly rounded shoulders 20 give the canopy 16 the appearance of a dome.

Figure 2:
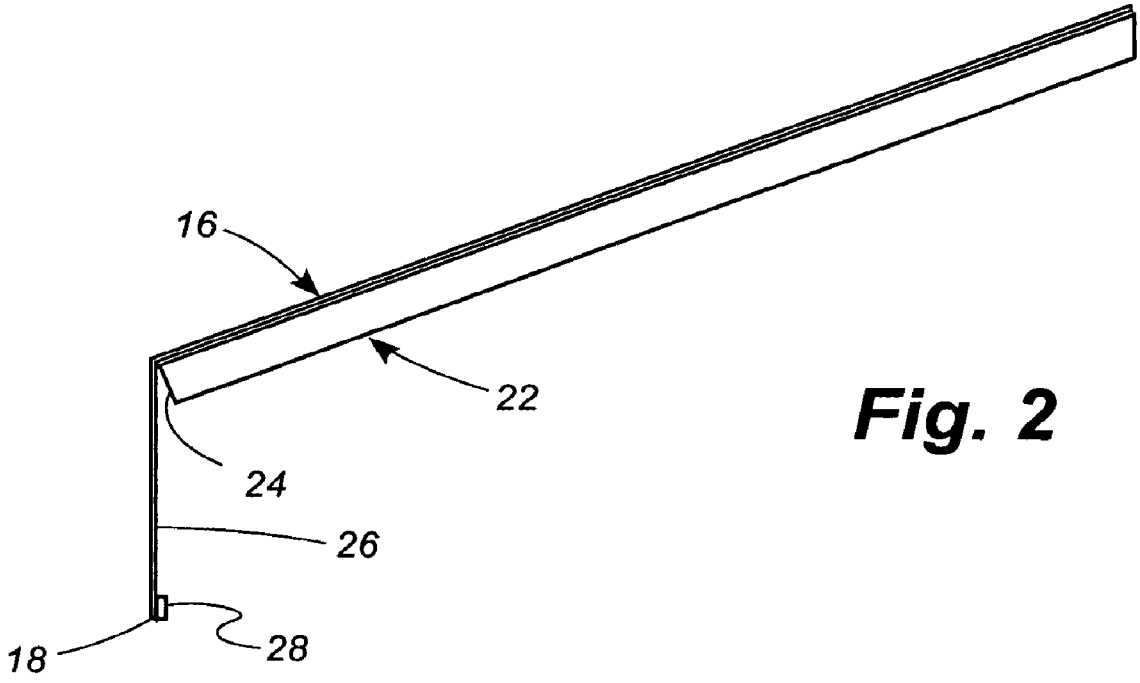
FIG. 2 is a cutaway view showing a rib and section of the canopy of the umbrella of FIG. 1.

FIGS. 2-5 illustrate the structure by which the smoothly rounded shoulders of the canopy are achieved. Referring first to FIG. 2, a rib 22 supports the canopy 16. The periphery 18 of the canopy extends beyond the outer end 24 of the rib 22. The canopy 16 has an inner surface 26. A fitting 28 is attached to the inner surface 26 of the canopy 16 adjacent its periphery 18.

Figure 3:
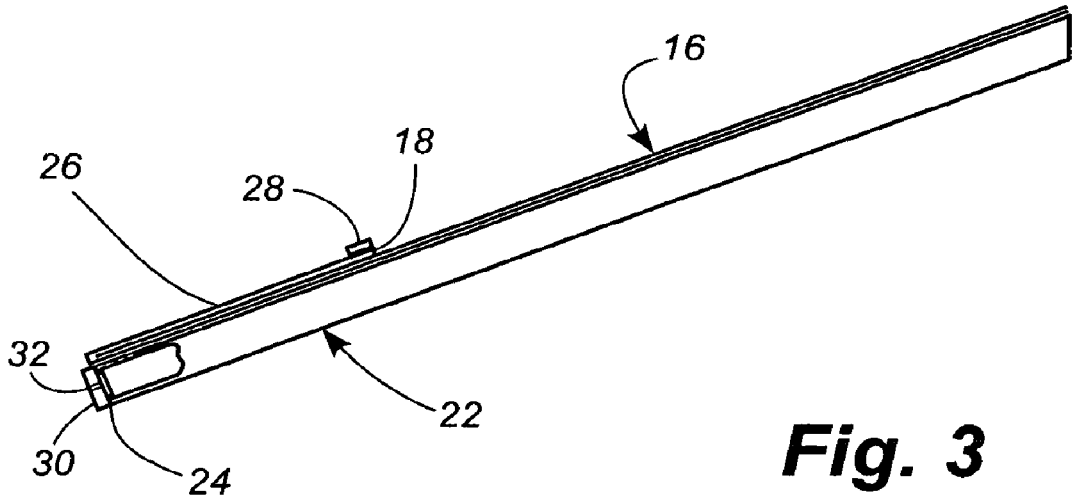
FIG. 3 is a cutaway view of the device of FIG. 2 showing the canopy perimeter folded back on top of the rib.

In FIG. 3 the canopy 16 is folded back to expose the outer end 24 of the rib 22. A cap 30 is fitted onto the end 24 of the rib 22 and has a hole 32 formed therein. The hole 32 is generally aligned with the longitudinal axis of the rib 22.

Figure 4:
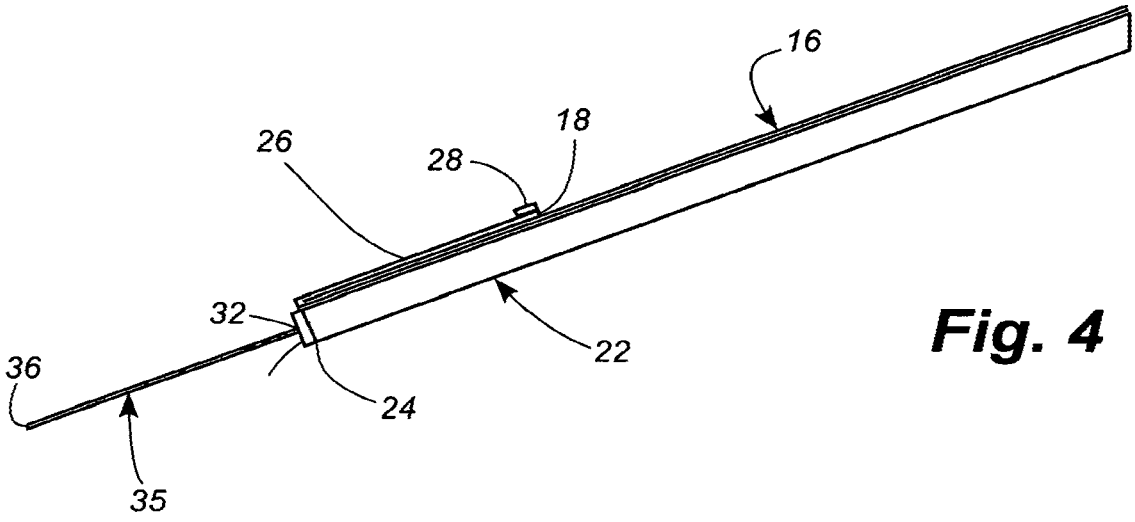
FIG. 4 is a cutaway view of the device of FIG. 2 showing a resilient rod inserted into the end of the rib.

In FIG. 4 the canopy 16 is still folded back. An elongated, laterally flexible member 35 has an inner end inserted into the hole 32 in the cap 30. The outer end 36 of the member 35 extends beyond the end of the rib by about six to twelve inches in the disclosed embodiment, though the member 35 can be shorter or longer as may be needed.

Figure 5:
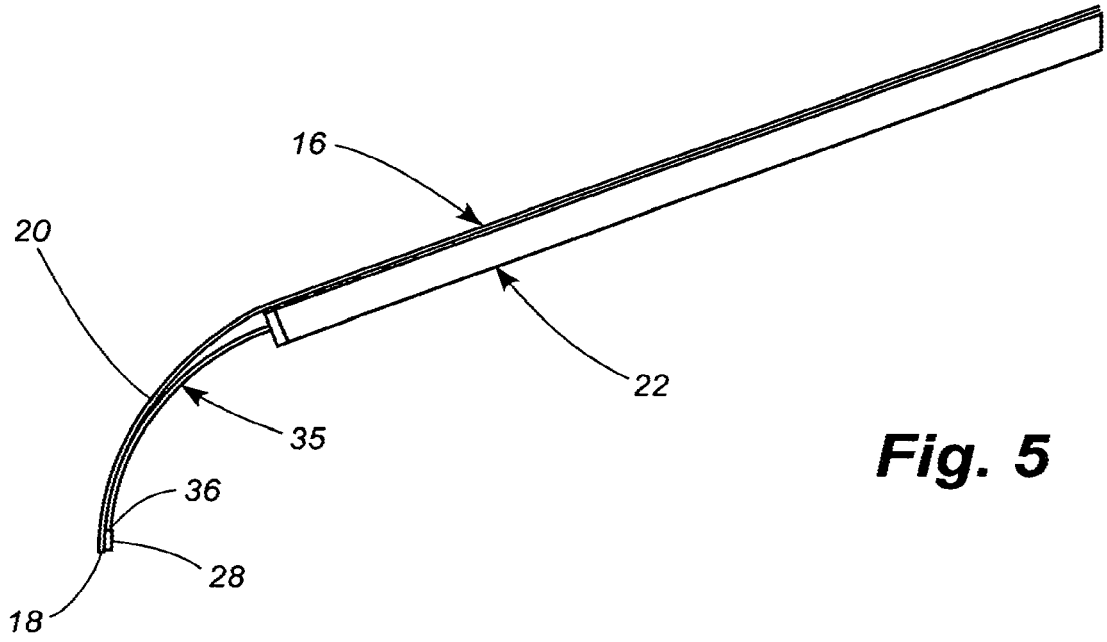
FIG. 5 is a cutaway view of the device of FIG. 2 showing the end of the rod inserted into a receptacle in the lower edge of the canopy, with the rod bent by tension of the canopy to form an arcuate shaped lower edge of the canopy.

In FIG. 5 the canopy 16 is extended down and over the flexible member 35. The end 36 of the flexible member 35 is inserted into the fitting 28 on the inner surface 26 of the canopy 16. The canopy 16 and the flexible member 35 are configured relative to one another so that the flexible member 35 extends from zero to two inches beyond the periphery of the canopy, and preferably from one-half to one inches beyond the periphery of the canopy. This dimensional difference places the canopy under stress and causes the flexible member 35 to flex downward and inward. The shoulder 20 of the canopy thus has a smooth, arcuate appearance, which gives the overall canopy a dome-like appearance.

In the disclosed embodiment the flexible members 35 are fiberglass rods, but a resilient, flexible metal such as spring steel can also be used. Also, while the flexible members 35 of the preferred embodiment are rods, it will be understood that flexible strips, that is, material having a greater width than thickness, can also be used. Also, in the preferred embodiment the outer ends 36 of the flexible members 35 are constrained by a fitting 28 attached to the inner surface 26 of the canopy 16. As an alternative, a pocket can be sewn into the inner surface 26 of the canopy 16 adjacent the periphery 18 into which the outer end 36 of the flexible member 35 can be inserted.

Finally, it will be understood that the preferred embodiment has been disclosed by way of example, and that other modifications may occur to those skilled in the art without departing from the scope and spirit of the appended claims.

What is claimed is:

1. An umbrella, comprising:

a vertical support member;

a plurality of ribs each of which has a first end pivotably mounted to an upper portion of said vertical support member and a second free end;

a corresponding plurality of end caps, one of said end caps being fixedly attached to said free end of each of said ribs in stationary position with respect thereto;

a corresponding plurality of elongated flexible members, each of said flexible members having an inner end fixedly attached to a corresponding one of said end caps in stationary position with respect thereto, and an outer end extending outward from said free end of a corresponding one of said ribs;

each of said end caps maintaining said inner end of said corresponding flexible member in fixed relation to the free end of an associated rib and in stationary position with respect thereto;

a canopy supported by said plurality of ribs and having a periphery extending beyond said free ends of said ribs, said canopy having an inner surface;

a plurality of receptacles disposed on the inner surface of said canopy, each of said receptacles located at a point proximate the periphery thereof and in substantial alignment with a corresponding one of said plurality of ribs, each of said plurality of flexible members engaging a corresponding one of said plurality of receptacles, said canopy and said flexible members being configured such that said canopy exerts a tension on said flexible member that causes it to flex inward and downward.

2. The umbrella of claim 1, wherein said elongated flexible members comprise rods.

3. The umbrella of claim 1, wherein said elongated flexible members comprise strips.

4. The umbrella of claim 1, wherein said elongated flexible members are formed of fiberglass.

5. The umbrella of claim 1, wherein said elongated flexible members are formed of metal.

6. The umbrella of claim 1, wherein said elongated flexible members have a length of from six to twelve inches.

7. The umbrella of claim 1, wherein said receptacles comprise fittings attached to said inner surface of said canopy, said fittings having a hole therein for receiving said outer end of one of said elongated flexible members.

8. The umbrella of claim 1, wherein said receptacles comprise pockets formed in said inner surface of said canopy and configured to receive said outer end of one of said elongated flexible members.

9. The umbrella of claim 1, wherein said plurality of elongated flexible members extend outward beyond said ribs by zero to two inches more than said canopy extends outward beyond said free ends of said ribs.

10. The umbrella of claim 9, wherein said plurality of elongated flexible members extend outward beyond said ribs by one-half to one inches more than said canopy extends outward beyond said free ends of said ribs.

11. The umbrella of claim 1, wherein each of said end caps maintain said inner end of said corresponding flexible member in coaxial relation with said rib.

12. A method of assembling a canopy to an umbrella frame, said umbrella frame having a plurality of ribs extending radially from a vertical support member, and said method comprising the steps of:

fitting a cap having a receptacle therein onto the end of each of said plurality of ribs such that said cap is in fixed relationship to a corresponding one of said plurality of ribs and in stationary position with respect thereto;

inserting an inner end of each of a plurality of elongated flexible members into the receptacle in a corresponding one of said each caps such that said inner end of each of said plurality of elongated flexible members is maintained in fixed relation to an associated one of said ribs and in stationary position with respect thereto; and securing a canopy to the outer ends of each of said elongated, flexible members.

* * * * *